US010302283B2

(12) United States Patent
Moon et al.

(10) Patent No.: US 10,302,283 B2
(45) Date of Patent: May 28, 2019

(54) LED CEILING LIGHT AND METHOD FOR CONNECTING LED CEILING LIGHT TO E26/E27 LIGHT HOLDER

(71) Applicant: Sang Pil Moon, Seoul (KR)

(72) Inventors: Dai Sung Moon, Seoul (KR); Sang Pil Moon, Seoul (KR)

(73) Assignee: Sang Pil Moon, Seoul (KR)

( * ) Notice: Subject to any disclaimer, the term of this patent is extended or adjusted under 35 U.S.C. 154(b) by 0 days.

(21) Appl. No.: 16/043,183

(22) Filed: Jul. 24, 2018

(65) Prior Publication Data

US 2018/0328574 A1 Nov. 15, 2018

Related U.S. Application Data

(63) Continuation-in-part of application No. PCT/CN2016/084664, filed on Jun. 3, 2016.

(51) Int. Cl.

| | |
|---|---|
| ***F21S 8/04*** | (2006.01) |
| ***F21K 9/237*** | (2016.01) |
| ***F21K 9/238*** | (2016.01) |
| ***F21V 21/02*** | (2006.01) |

(52) U.S. Cl.

CPC ..... *F21V 21/02* (2013.01); *F21K 9/237* (2016.08); *F21S 8/04* (2013.01); *F21K 9/238* (2016.08)

(58) Field of Classification Search

CPC ..... F21V 21/02; F21K 9/237; F21K 9/238; F21S 8/04

See application file for complete search history.

(56) References Cited

U.S. PATENT DOCUMENTS

| | | | | |
|---|---|---|---|---|
| 7,611,264 | B1 * | 11/2009 | Chang | F21K 9/00 362/249.02 |
| 2016/0116146 | A1 * | 4/2016 | Van Winkle | F21V 3/0625 362/311.02 |
| 2016/0348862 | A1 * | 12/2016 | Liang | F21V 5/007 |

FOREIGN PATENT DOCUMENTS

| | | | | |
|---|---|---|---|---|
| CN | 201382344 | Y | 1/2010 | |
| CN | 201547604 | U | 8/2010 | |
| CN | 202216191 | U | 5/2012 | |
| CN | 204164967 | U | 2/2015 | |
| CN | 205278909 | U | 6/2016 | |
| WO | WO-2014079138 | A1 * | 5/2014 | F21S 8/04 |

OTHER PUBLICATIONS

International Search Report of PCT Patent Application No. PCT/CN2016/084664 dated Mar. 1, 2017.

* cited by examiner

*Primary Examiner* — Mary Ellen Bowman

(57) ABSTRACT

The present invention relates to an LED ceiling light, comprising a light body and a back plate, the light body is detachably connected to the back plate. When an outer circular frame of the back plate is sheathed into a round throat of the light body, a columnar clip of the light body of the LED ceiling light runs from a bottom of the back plate and is rotated to clip in an L-shaped slot until reaches a close end of the L-shaped slot, in this way, the light body is connected to the back plate.

4 Claims, 5 Drawing Sheets

LED CEILING LIGHT AND METHOD FOR CONNECTING LED CEILING LIGHT TO E26/E27 LIGHT HOLDER

CROSS-REFERENCE TO RELATED APPLICATIONS

The present application is a Continuation-in-part Application of PCT application No. PCT/CN2016/084664 filed on Jun. 3, 2016, the contents of the above are hereby incorporated by reference.

FIELD OF THE INVENTION

The present invention relates to an LED ceiling light and a method for connecting the LED ceiling light to an E26/E27 light holder.

BACKGROUND OF THE INVENTION

The CN 200920071753.6 has disclosed a novel tube lamp. This utility model, aims at adopting both recessed lamp and improved ceiling lamp, not only provides an effective solution to the problem that ceiling lamp cannot be directly installed in the fitment structure of existing recessed lamp but also achieves the purpose of reducing a plurality of recessed lamps to one for lighting. The technical solution according to this utility model is that the novel tube lamp comprises a common recessed lamp seat and a ceiling lamp. The common recessed lamp seat can be recessed in an object; the ceiling lamp comprises a ceiling disc, a light blocking cover, a ballast and a lamp tube; the tube lamp further comprises a switching device, and the ceiling lamp which is fixedly arranged on the recessed lamp seat by the switching device is communicated with the recessed lamp seat. The drawback of the novel tube lamp is that the lamp as a whole is so big that affects its aesthetic appearance.

However, if customers choosing to use LED ceiling lights, two options are commonly available. One is that an E26/E27 light holder has already been installed in the ceiling so that customers could screw an E26/E27screw base of the LED ceiling light in to use; the other option is that the ceiling does not provide an E26/E27 light holder but only a contact wire left out, customers thus need to connect the E26/E27 screw base of the LED ceiling light electrically to the wire. Therefore, existing ceiling lights only provide customers with either option.

In one undesirable situation, when screwing the E26/E27 screw base of the LED ceiling light into an E26/E27 light holder recessed in the ceiling, electrical connection maybe absent on the basis that the light cover will stop the screw base from hitting the end of the light holder when the light cover touches the ceiling. In another undesirable situation, where the light holder is barely attached to the ceiling, there will be a space left between the light cover and the ceiling when screwing the screw base in the light holder, which leads to an unstable and unfavorable installation of a ceiling light and also inability of waterproof.

SUMMARY OF THE INVENTION

The present invention aims at overcoming the drawback of existing technology and providing an LED ceiling light when there is no E26/E27 light holder available for a direct installation. The ceiling light allows customers to arrange a back plate affixed to the ceiling and connect a contact wire left on the ceiling to a terminal block of a ceiling light body, and then screw the ceiling light body to be fastened to the back plate to get the installation done. The present invention further aims at providing an installation method that allows mounting an existing ceiling light to an E26/E27 light holder through providing a back plate without changing the structure of existing ceiling light.

The present invention also aims at providing an LED ceiling light having a screw base which is adjustable between an elastically recovered position and an elastically lifted-up position, therefore, the screw base of the LED ceiling light is able to be lifted up to hit the end of the light holder.

The technical solution is an LED ceiling light, comprising a light body and a back plate, wherein the light body is detachably connected to the back plate.

In one embodiment, the back plate consists of: an outer circular frame and an inner circular frame that are concentrically placed in a same plane; two radially-arranged connectors arranged between an inner wall of the outer circular frame and an outer wall of the inner circular frame, where each connector has an oval ring; two pairs of reinforcing bars, where each pair of the reinforcing bars are arranged at two sides of each said connector and connect the inner wall of the outer circular frame and the outer wall of the inner circular frame; a wallboard that is placed between the inner wall of the outer circular frame and the outer wall of the inner circular frame and divided by the two connectors and the two pairs of reinforcing bars; a flange that is centrifugally extending from an edge of the outer circular frame; and a plurality of recessed L-shaped slots that are arranged on an outer wall of the outer circular frame.

In this embodiment, the light body of the LED ceiling light comprises: a round throat; an annular plate that is fixedly mounted to a bottom of the round throat; a concave hole that concaves at a center of the annular plate; columnar clips that are protruding from an inner wall of the round throat and corresponding respectively to each L-shaped slot; a receiving groove that is concaved from the annular plate beside one columnar clip and communicating with the concave hole for fixedly holding a terminal block; an upper light shell that is extended from a bottom of the round throat in one piece; a light shade that is connected to the upper light shell; an LED printed circuit board having a centric through hole for passing the concave hole and the receiving groove; a tapered chamber that is sheathed in the centric through hole of the LED printed circuit board; and a sensor printed circuit board that is sheathed in the tapered chamber.

In this embodiment, when the outer circular frame of the back plate is sheathed into the round throat of the light body, the columnar clip of the light body of the LED ceiling light runs from a bottom of the back plate and is rotated to clip in the L-shaped slot until reaches a close end of the L-shaped slot, in this way, the light body is connected to the back plate.

In another embodiment, the back plate consists of: a circumferential wall rising up from an annular base; a round platform upwardly protruding from the annular base; an annular groove that is formed between the circumferential wall and the round platform; a centric through hole that is opened in the round platform; radially-arranged connectors formed between a circumferential edge of the centric through hole and a circumferential edge of the round platform, where each connector has an oval ring; at least one reinforcing bar that is arranged between every two connectors; a flange that is extended radially from a top edge of the circumferential wall; and L-shaped slots that concave in an outer surface of the circumferential wall. Wherein an annular indentation is formed by a bottom of the circumferential wall concaving and downwardly extending; an open end of the L-shaped slot deviates from the annular indentation, which makes it convenient for the light body to slip along the annular indentation and then into the L-shaped slot.

In this embodiment, the light body comprises: a round throat; an annular plate that is fixedly mounted to a bottom of the round throat; a protruding step formed at a center of the annular plate and having a protruding column; columnar clips that are protruding from an inner wall of the round throat and corresponding respectively to each L-shaped slot; a receiving groove that is concaved from the annular plate beside one columnar clip for holding a terminal block; a tapered upper light shell that is fixedly mounted to a bottom of the round throat; an LED printed circuit board that is installed at a lower portion of the tapered upper light shell; a tapered piece installed at a bottom of the LED printed circuit board; a light shade that is connected to the upper light shell; and a screw base assembly arranged on the protruding step. Wherein an annular groove concaves in a top portion of the round throat and a waterproof ring is arranged in the annular groove; the tapered piece covers electronic components on the LED printed circuit board rather than an LED light source, in this way, after the installation of the LED ceiling light, only the LED light source is visible while the electronic components and wires are invisible when looking at the light shade.

In this embodiment, the screw base assembly comprises: a screw base; a shaft sleeve sheathed in a chamber of the screw base; slots that symmetrically concave in the shaft sleeve; a closed annular chamber that is formed between an outer surface of the protruding column and an inner wall of the shaft sleeve; a spring that is arranged in the annular chamber; and a cap piece that is located on a top of the spring and in the annular chamber; wherein the cap piece consists of a round board, a pair of thread holes and a pair of screw holes that are arranged symmetrically and alternately on the round board.

The beneficial effects of this invention are set out as follows. Firstly, the present ceiling light provides a screw base where the ceiling of the customer's house has already been installed an E26/E27 light holder. Installation will be finalized when customers screwing in the matching screw base. However if, there is no E26/E27 light holder provided on the ceiling, customers could fix the back plate (works as an adaptor) of the ceiling light of the present invention on the ceiling, connect the wires left out the ceiling to the terminal block of the ceiling light body, and then screw the ceiling light body to be fastened to the back plate to get the installation done. Secondly, the technique is able to be applied to sensor ceiling lights and non-sensor ceiling lights. Thirdly, it is easy and convenient to install. Fourthly, the technique makes a ceiling light structural simple while retaining the original style of a ceiling light.

DETAILED DESCRIPTION OF ILLUSTRATED EMBODIMENTS

Embodiments of the present invention are further explained clearly as follows in conjunction with figures.

Figure 1:
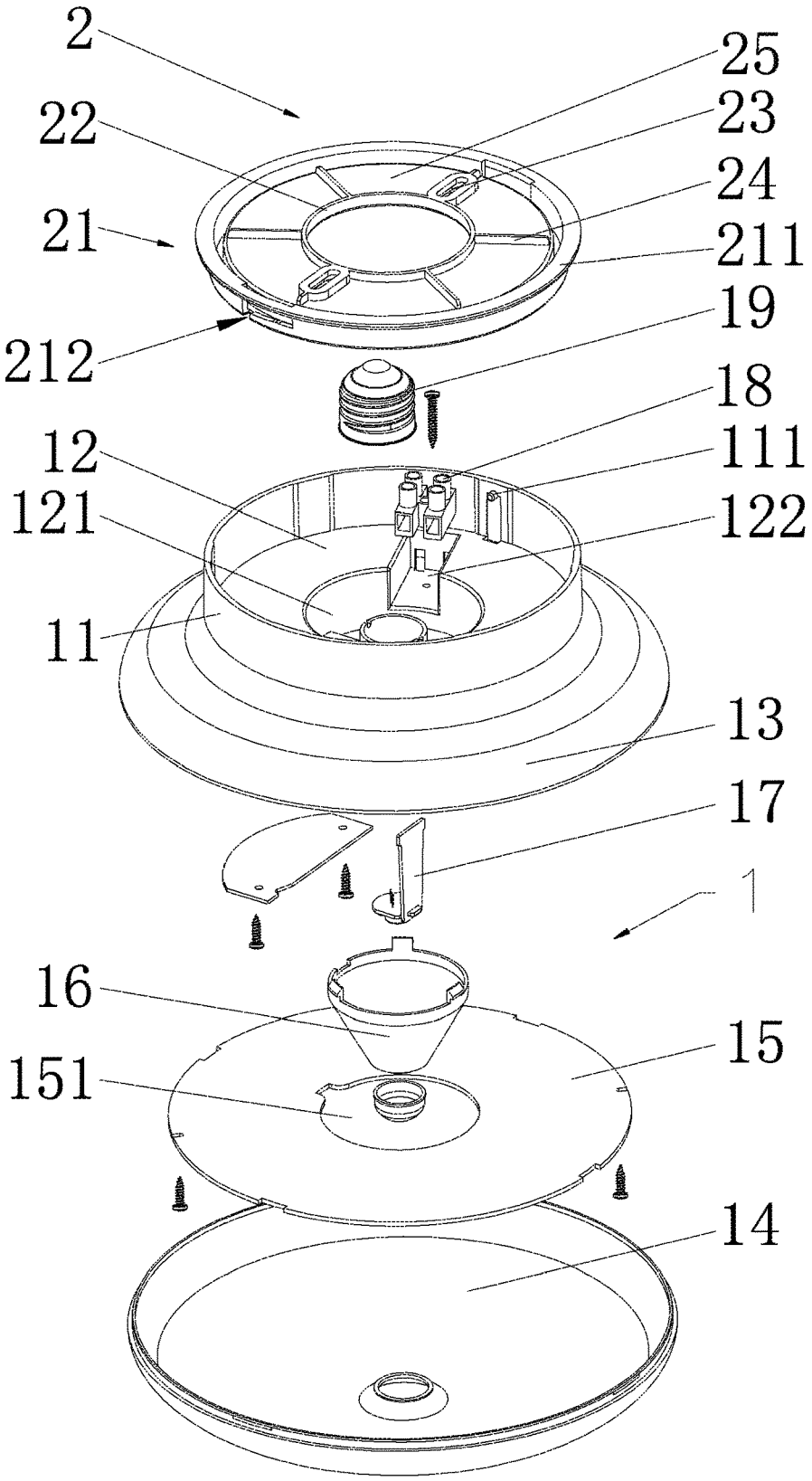
FIG. 1 is an exploded view of an LED ceiling light according to a first embodiment of the present invention.
Figure 2:
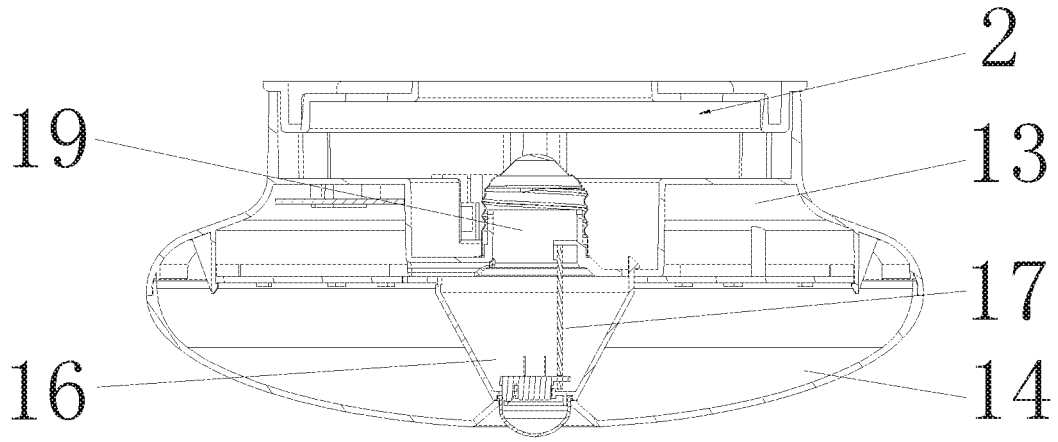
FIG. 2 is a cross-sectional view of the LED ceiling light shown in FIG. 1.
Figure 3:
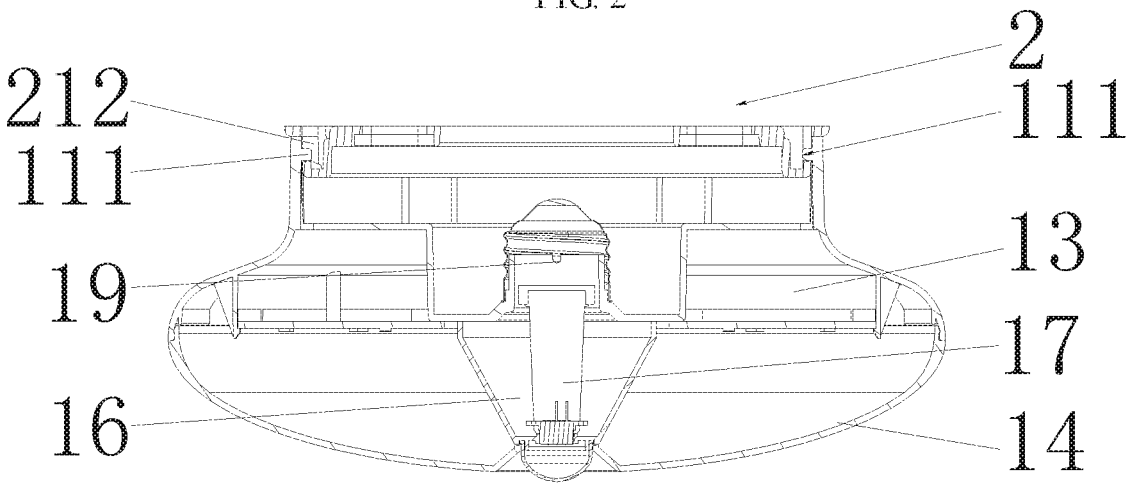
FIG. 3 is another cross-sectional view of LED the ceiling light shown in FIG. 1, wherein the cutting surface is perpendicular to that of FIG. 2.

FIGS. 1, 2 and 3 illustrate a first embodiment of an LED ceiling light of the present invention.

As shown in FIGS. 1 to 3, an LED ceiling light comprises a light body 1 and a back plate 2, the light body 1 is detachably connected to the back plate 2.

In the present embodiment, the back plate 2 consists of the following parts: an outer circular frame 21 and an inner circular frame 22 that are concentrically placed in a same plane; two radially-arranged connectors 23 arranged between an inner wall of the outer circular frame 21 and an outer wall of the inner circular frame 22, where each connector 23 has an oval ring; two pairs of reinforcing bars 24, where each pair of the reinforcing bars 24 are arranged at two sides of each said connector 23 and connecting the inner wall of the outer circular frame 21 and the outer wall of the inner circular frame 22; a wallboard 25 that is placed between the inner wall of the outer circular frame 21 and the outer wall of the inner circular frame 22 and divided by the two connectors 23 and the two pairs of reinforcing bars 24; a flange 211 that is centrifugally extending from an edge of the outer circular frame 21; and a plurality of recessed L-shaped slots 212 that are arranged on an outer wall of the outer circular frame 21.

In the present embodiment, the light body 1 of the LED ceiling light comprises a round throat 11; an annular plate 12 that is fixedly mounted to a bottom of the round throat 11; a concave hole 121 that concaves at a center of the annular plate 12; columnar clips 111 that are protruding from an inner wall of the round throat 11 and corresponding respectively to each L-shaped slot 212; a receiving groove 122 that is concaved from the annular plate 12 beside one columnar clip 111 and communicating with the concave hole 121 for fixedly holding a terminal block 18; an upper light shell 13 that is extended from a bottom of the round throat 11 in one piece; a light shade 14 that is connected to the upper light shell 13; an LED printed circuit board 15 having a centric through hole 151 for passing the concave hole 121 and the receiving groove 122; a tapered chamber 16 that is sheathed in the centric through hole 151 of the LED printed circuit board 15; and a sensor printed circuit board 17 that is sheathed in the tapered chamber 16.

In the present embodiment, when sheathing the outer circular frame 21 of the back plate 2 into the round throat 11 of the light body 1, the columnar clip 111 of the light body 1 of the LED ceiling light 1 runs from a bottom of the back plate 2 and is rotated to clip in the L-shaped slot 212 until reaches a close end of the L-shaped slot 212. The light body 1 therefore is connected to the back plate 2.

When a ceiling only provides wires, a method of connecting the LED ceiling light to the wires is set forth as follows: mounting the back plate 2 to the ceiling (not shown in figures) through screwing screws into through holes (not shown in figures) of the ceiling, connecting the terminal block 18 to the ceiling wires (not shown in figures), rotating the round throat 11 on to the back plate 2 with the inner wall of the round throat 11 wrapping an outer wall of the back plate 2 until the columnar clip 111 runs to clip in the L-shaped slot 212 of the back plate 2 and reaches a close end of the L-shaped slot 212.

When an E26/E27 light holder has already been installed in the ceiling, a method of connecting the LED ceiling light to the E26/E27 light holder comprises screwing the an E26/E27screw base 19 of the LED ceiling light into an E26/E27 light holder of a ceiling.

FIGS. 4 to 8 illustrate a second embodiment of an LED ceiling light of the present invention.

As shown in FIGS. 4 to 8, an LED ceiling light comprises a light body 1 and a back plate 2, the light body 1 is detachably connected to the back plate 2.

Figure 4:
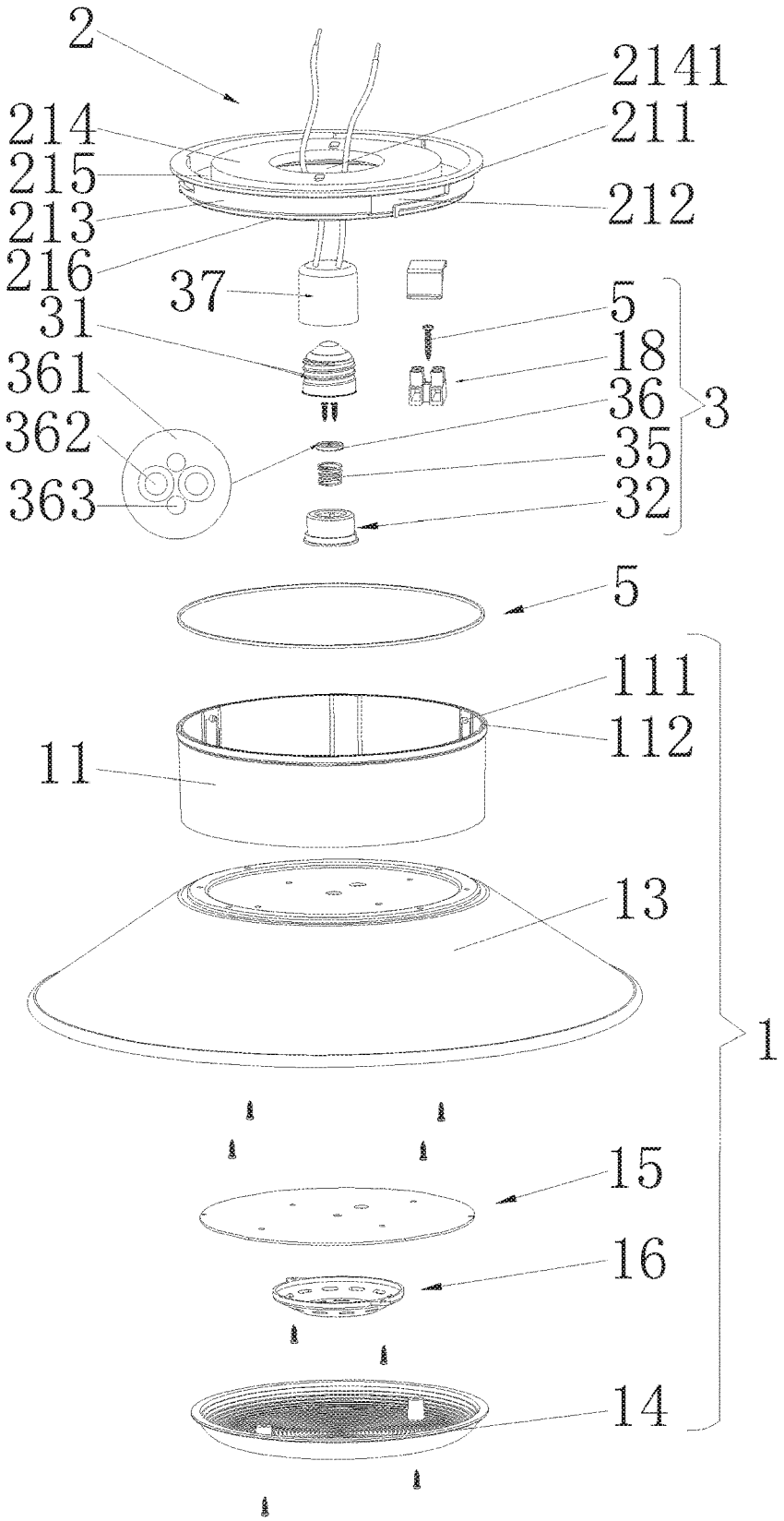
FIG. 4 is an exploded view of an LED ceiling light according to a second embodiment of the present invention.
Figure 5:
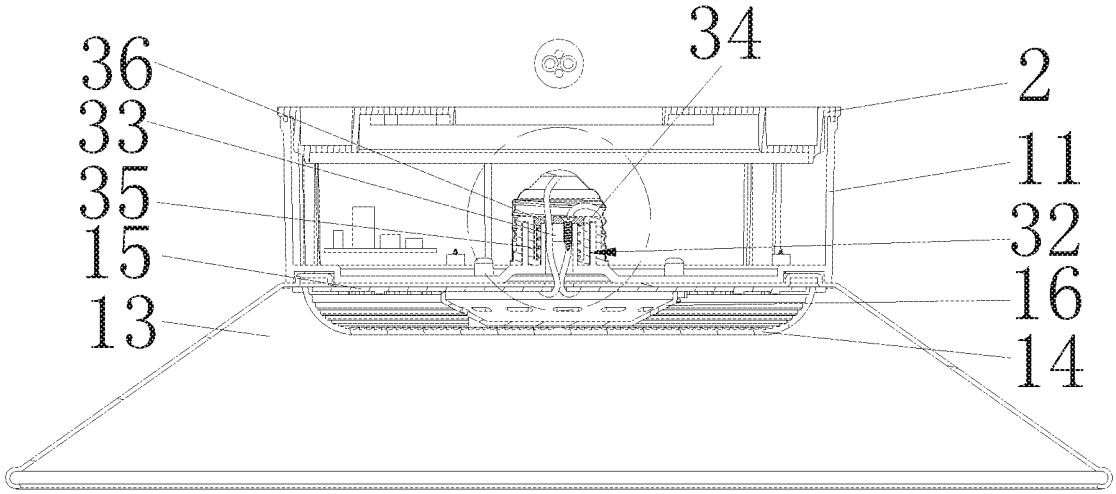
FIG. 5 is a cross-sectional view of the LED ceiling light shown in FIG. 4.

Referring to FIG. 4, In the present embodiment, the back plate 2 consists of a circumferential wall 213 rising up from an annular base; a round platform 214 upwardly protruding from the annular base; an annular groove 215 that is formed between the circumferential wall 213 and the round platform 214; a centric through hole 2141 that is opened in the round platform 214; radially-arranged connectors (not shown in figures) formed between a circumferential edge of the centric through hole 2141 and a circumferential edge of the round platform 214, where each connector has an oval ring (not shown in figures); at least one reinforcing bar (not shown in figures) that is arranged between every two connectors; a flange 211 that is extended radially from a top edge of the circumferential wall 213; and L-shaped slots 212 that concave in an outer surface of the circumferential wall 213. An annular indentation 216 is formed by a bottom of the circumferential wall 213 concaving and downwardly extending. An open end of the L-shaped slot 212 deviates from the annular indentation 216, which makes it convenient for the light body 1 to slip along the annular indentation 216 and then into the L-shaped slot 212.

Figure 8:
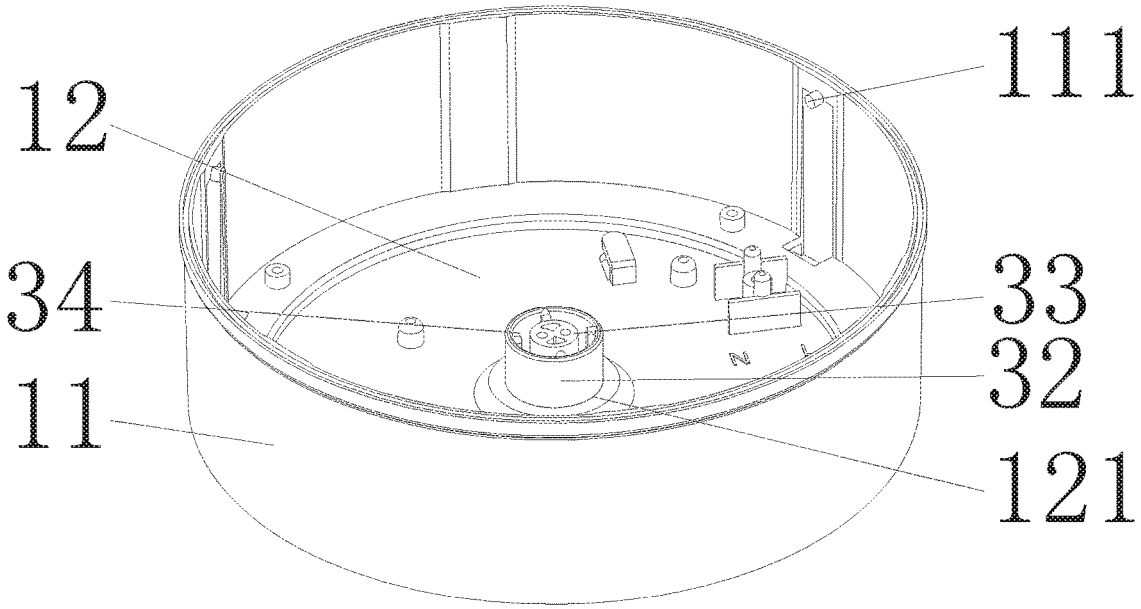
FIG. 8 is a schematic view of a part of a ceiling light body of the LED ceiling light according to the second embodiment of the present invention.

Referring to FIG. 8, In the present embodiment, the light body 1 comprises a round throat 11; an annular plate 12 that is fixedly mounted to a bottom of the round throat 11; a protruding step 121 formed at a center of the annular plate 12 and having a protruding column 33; columnar clips 111 that are protruding from an inner wall of the round throat 11 and corresponding respectively to each L-shaped slot 212; a receiving groove that is concaved from the annular plate 12 beside one columnar clip 111 for holding a terminal block 18; a tapered upper light shell 13 that is fixedly mounted to a bottom of the round throat 11; an LED printed circuit board 15 that is installed at a lower portion of the tapered upper light shell 13; a tapered piece 16 installed at a bottom of the LED printed circuit board 15; a light shade 14 that is connected to the upper light shell 13; and a screw base assembly 3 arranged on the protruding step 121. An annular groove 112 concaves in a top portion of the round throat 11 and a waterproof ring 5 is arranged in the annular groove 112. The tapered piece 16 is used for covering electronic components on the LED printed circuit board 15 rather than an LED light source. Thus after the installation of the LED ceiling light, only the LED light source is visible while the electronic components and wires are invisible when looking at the light shade 14.

In the present embodiment, the screw base assembly 3 comprises a screw base 31; a shaft sleeve 32 sheathed in a chamber of the screw base 31; slots 321 that symmetrically concave in the shaft sleeve 32; a closed annular chamber 34 that is formed between an outer surface of the protruding column 33 and an inner wall of the shaft sleeve 32; a spring 35 that is arranged in the annular chamber 34; and a cap piece 36 that is located on a top of the spring 35 and in the annular chamber 34. The cap piece 36 consists of a round board 361; a pair of thread holes 363 and a pair of screw holes 362 that are arranged symmetrically and alternately on the round board 361.

Figure 6:
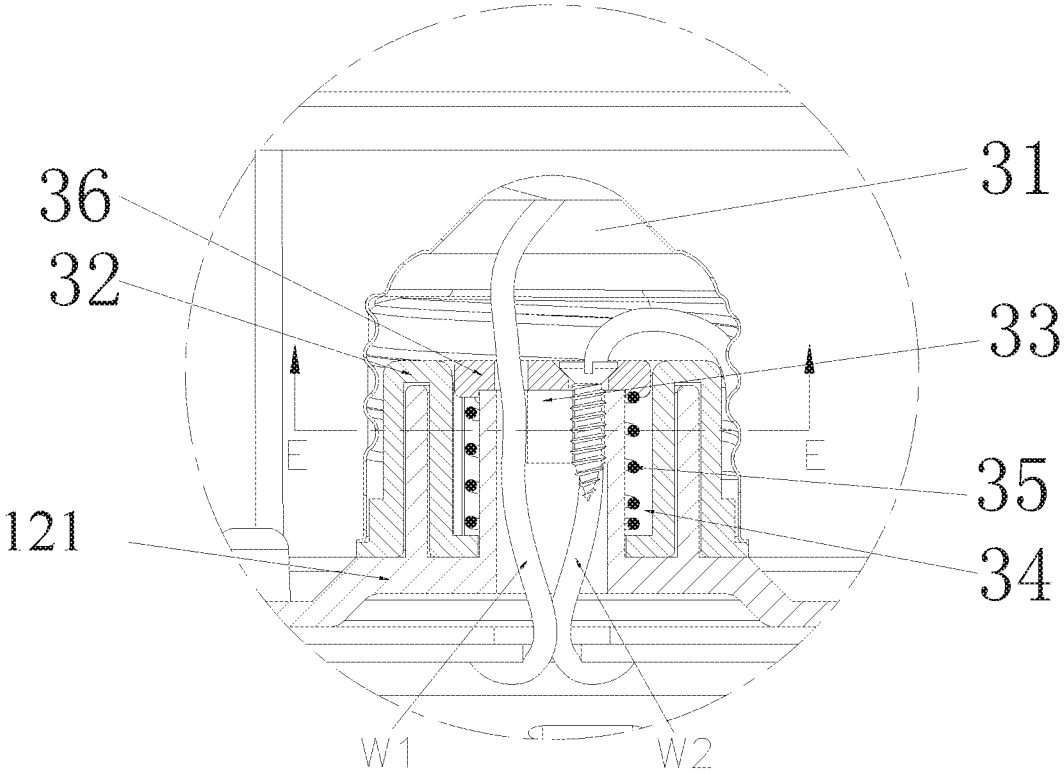
FIG. 6 is an enlarged view of a screw base assembly of the LED ceiling light in FIG. 5.
Figure 7:
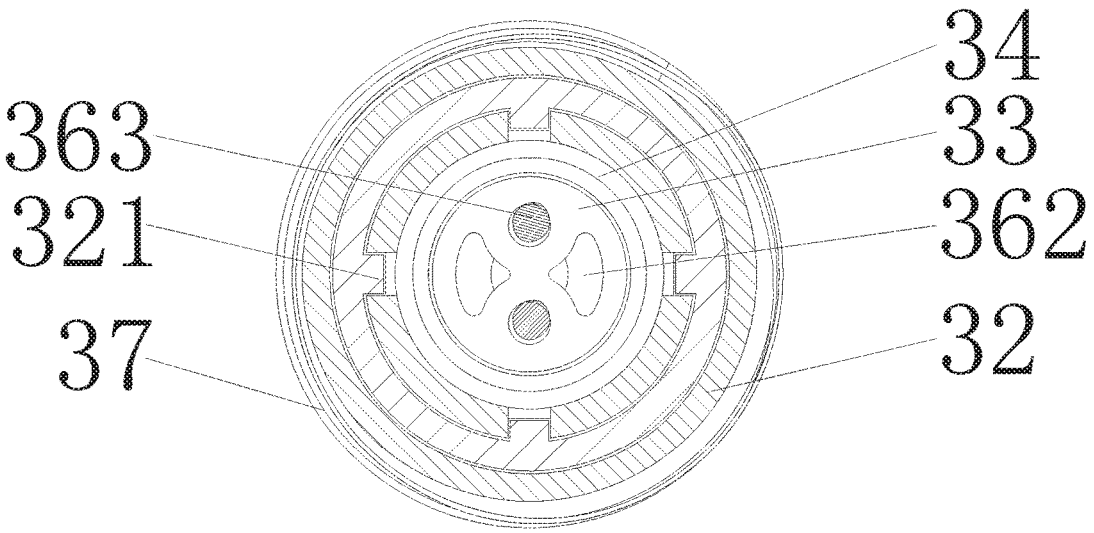
FIG. 7 is a cross-sectional view of the screw base assembly taken along line E-E of FIG. 6.

Referring to FIG. 6, the screw base 31 is fixed to the shaft sleeve 32, the cap piece 36 is fixed on the top of the protruding column 33 through a screw. Under normal conditions, the screw base 31 is in an elastically recovered position (as shown in FIG. 6). After the screw base 31 is lifted up, the spring 35 is compressed and the screw base 31 is an elastically lifted-up position. Therefore, the screw base 31 is adjustable between an elastically recovered position and an elastically lifted-up position. When an E26/E27 light holder is recessed in the ceiling, the LED ceiling light of the present invention ensures an electrical connection of the light holder and the screw base of the LED ceiling light, because the screw base 31 is able to be lifted up to hit the end of the light holder.

What is claimed is:

1. An LED ceiling light, comprising a light body and a back plate, wherein the light body is detachably connected to the back plate;

wherein the back plate consists of:

an outer circular frame and an inner circular frame that are concentrically placed in a same plane;

two radially-arranged connectors arranged between an inner wall of the outer circular frame and an outer wall of the inner circular frame, where each connector has an oval ring;

two pairs of reinforcing bars, where each pair of the reinforcing bars are arranged at two sides of each said connector and connect the inner wall of the outer circular frame and the outer wall of the inner circular frame;

a wallboard that is placed between the inner wall of the outer circular frame and the outer wall of the inner circular frame and divided by the two connectors and the two pairs of reinforcing bars;

a flange that is centrifugally extending from an edge of the outer circular frame; and a plurality of recessed L-shaped slots that are arranged on an outer wall of the outer circular frame;

wherein the light body of the LED ceiling light comprises:

a round throat;

an annular plate that is fixedly mounted to a bottom of the round throat;

a concave hole that concaves at a center of the annular plate;

columnar clips that are protruding from an inner wall of the round throat and corresponding respectively to each L-shaped slot;

a receiving groove that is concaved from the annular plate beside one columnar clip and communicating with the concave hole for fixedly holding a terminal block;

an upper light shell that is extended from a bottom of the round throat in one piece;

a light shade that is connected to the upper light shell;

an LED printed circuit board having a centric through hole for passing the concave hole and the receiving groove;

a tapered chamber that is sheathed in the centric through hole of the LED printed circuit board; and a sensor printed circuit board that is sheathed in the tapered chamber.

2. The LED ceiling light of claim 1, when the outer circular frame of the back plate is sheathed into the round throat of the light body, the columnar clip of the light body of the LED ceiling light runs from a bottom of the back plate and is rotated to clip in the L-shaped slot until reaches a close end of the L-shaped slot, in this way, the light body is connected to the back plate.

3. An LED ceiling light, comprising a light body and a back plate, wherein the light body is detachably connected to the back plate;

wherein the back plate consists of:

a circumferential wall rising up from an annular base;

a round platform upwardly protruding from the annular base;

an annular groove that is formed between the circumferential wall and the round platform;

a centric through hole that is opened in the round platform;

radially-arranged connectors formed between a circumferential edge of the centric through hole and a circumferential edge of the round platform, where each connector has an oval ring;

at least one reinforcing bar that is arranged between every two connectors;

a flange that is extended radially from a top edge of the circumferential wall; and L-shaped slots that concave in an outer surface of the circumferential wall;

wherein an annular indentation is formed by a bottom of the circumferential wall concaving and downwardly extending; an open end of the L-shaped slot deviates from the annular indentation, which makes it convenient for the light body to slip along the annular indentation and then into the L-shaped slot;

wherein the light body comprises:

a round throat;

an annular plate that is fixedly mounted to a bottom of the round throat;

a protruding step formed at a center of the annular plate and having a protruding column;

columnar clips that are protruding from an inner wall of the round throat and corresponding respectively to each L-shaped slot;

a receiving groove that is concaved from the annular plate beside one columnar clip for holding a terminal block;

a tapered upper light shell that is fixedly mounted to a bottom of the round throat;

an LED printed circuit board that is installed at a lower portion of the tapered upper light shell;

a tapered piece installed at a bottom of the LED printed circuit board;

a light shade that is connected to the upper light shell; and a screw base assembly arranged on the protruding step;

wherein an annular groove concaves in a top portion of the round throat and a waterproof ring is arranged in the annular groove; the tapered piece covers electronic components on the LED printed circuit board rather than an LED light source, in this way, after the installation of the LED ceiling light, only the LED light source is visible while the electronic components and wires are invisible when looking at the light shade.

4. The LED ceiling light of claim 3, wherein the screw base assembly comprises:

a screw base;

a shaft sleeve sheathed in a chamber of the screw base;

slots that symmetrically concave in the shaft sleeve;

a closed annular chamber that is formed between an outer surface of the protruding column and an inner wall of the shaft sleeve;

a spring that is arranged in the annular chamber; and a cap piece that is located on a top of the spring and in the annular chamber;

wherein the cap piece consists of a round board, a pair of thread holes and a pair of screw holes that are arranged symmetrically and alternately on the round board.

* * * * *